US011564453B2

(12) United States Patent
Gu

(10) Patent No.: US 11,564,453 B2
(45) Date of Patent: Jan. 31, 2023

(54) ADAPTOR FOR BICYCLE SHOES

(71) Applicant: Haidong Gu, Pomona, CA (US)

(72) Inventor: Haidong Gu, Pomona, CA (US)

(73) Assignee: CYCLINGDEAL USA, INC., Pomona, CA (US)

( * ) Notice: Subject to any disclaimer, the term of this patent is extended or adjusted under 35 U.S.C. 154(b) by 149 days.

(21) Appl. No.: 17/179,334

(22) Filed: Feb. 18, 2021

(65) Prior Publication Data

US 2022/0256976 A1 Aug. 18, 2022

(51) Int. Cl.

| | |
|---|---|
| ***A43B 5/14*** | (2006.01) |
| ***A43C 15/16*** | (2006.01) |
| ***A43B 13/26*** | (2006.01) |
| ***A43C 15/02*** | (2006.01) |

(52) U.S. Cl.

CPC ..... *A43C 15/161* (2013.01); *A43B 5/14* (2013.01); *A43B 13/26* (2013.01); *A43C 15/02* (2013.01)

(58) Field of Classification Search

CPC ..... A43B 5/14; B62M 3/086; A43C 15/02

See application file for complete search history.

(56) References Cited

U.S. PATENT DOCUMENTS

| | | | | |
|---|---|---|---|---|
| 2006/0016102 | A1* | 1/2006 | Xie | A43B 5/14 36/131 |
| 2006/0080865 | A1* | 4/2006 | Chao | A43B 5/14 36/131 |
| 2007/0084086 | A1* | 4/2007 | Bryne | B62M 3/086 36/131 |
| 2008/0110294 | A1* | 5/2008 | Bryne | A43B 5/14 74/594.6 |
| 2021/0163096 | A1* | 6/2021 | Gu | A43B 5/14 |

* cited by examiner

*Primary Examiner* — Ted Kavanaugh

(57) ABSTRACT

An adaptor is connected to a bicycle shoe and includes an engaging portion and a base part. The engaging portion is formed on the first side of the base part, and protrudes from the first side of the base part so as to be connected to the underside of the bicycle shoe. A recess is defined in the second side of the base part and includes two first holes defined through its inner bottom. The two first holes are defined through the engaging portion. Two locking members extend through the two first holes and are connected to the bicycle shoe. A cleat is removably connected to the second side of the base part. The bicycle shoes with the cleat are used as mountain bike shoes, and used as road bike shoes by removing the cleats.

6 Claims, 6 Drawing Sheets

ADAPTOR FOR BICYCLE SHOES

BACKGROUND OF THE INVENTION

1. Fields of the Invention

The present invention relates to a bicycle shoe, and more particularly, to an adaptor for a bicycle shoe so that a cleat is removably connected to the adaptor.

2. Descriptions of Related Art

There are two main catalogues for bicycles, and which are road bikes and mountain bikes. The shoes for being used with the pedals of the two different types of bicycles are also divided into two different types. For road bikes, the shoes are equipped with a specific designed cleat attached to the underside of the shoe so as to be engaged with the pedals of the mountain bikes. For the mountain bikes, the shoes have a flat underside. Therefore, the two types of shoes are required if the users want to use both the road bikes and the mountain bikes. However, the bike shoes are costly, and the users have to prepare the two different types so as to enjoy the pedaling of the two different types of bikes. It is inconvenient for the user to carry the two different shoes as well.

The present invention intends to provide an adaptor for a bicycle shoe. A cleat for road bikes can be removably connected to the adaptor to switch the shoe from a road bike shoe to a mountain bike shoe.

SUMMARY OF THE INVENTION

The present invention relates to an adaptor for a bicycle shoe, and includes an engaging portion and a base part. The engaging portion is formed on the first side of the base part, and protrudes from the first side of the base part so as to be connected to the underside of the bicycle shoe. A recess is defined in the second side of the base part and includes two first holes defined through its inner bottom. The two first holes are defined through the engaging portion. Two locking members extend through the two first holes and are connected to the bicycle shoe. A cleat is removably connected to the second side of the base part. The bicycle shoes with the cleat are used as mountain bike shoes, and used as road bike shoes by removing the cleats.

The user only needs to prepare the bicycle shoes, by using the adapter of the present invention, when riding a mountain bike, the user wears the bicycle shoes without the cleat. When riding a road bike, the cleat is attached to the engaging portion of the adaptor of the present invention. The user does not need to change the bicycle shoes and are able to ride mountain hokes and the road bikes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
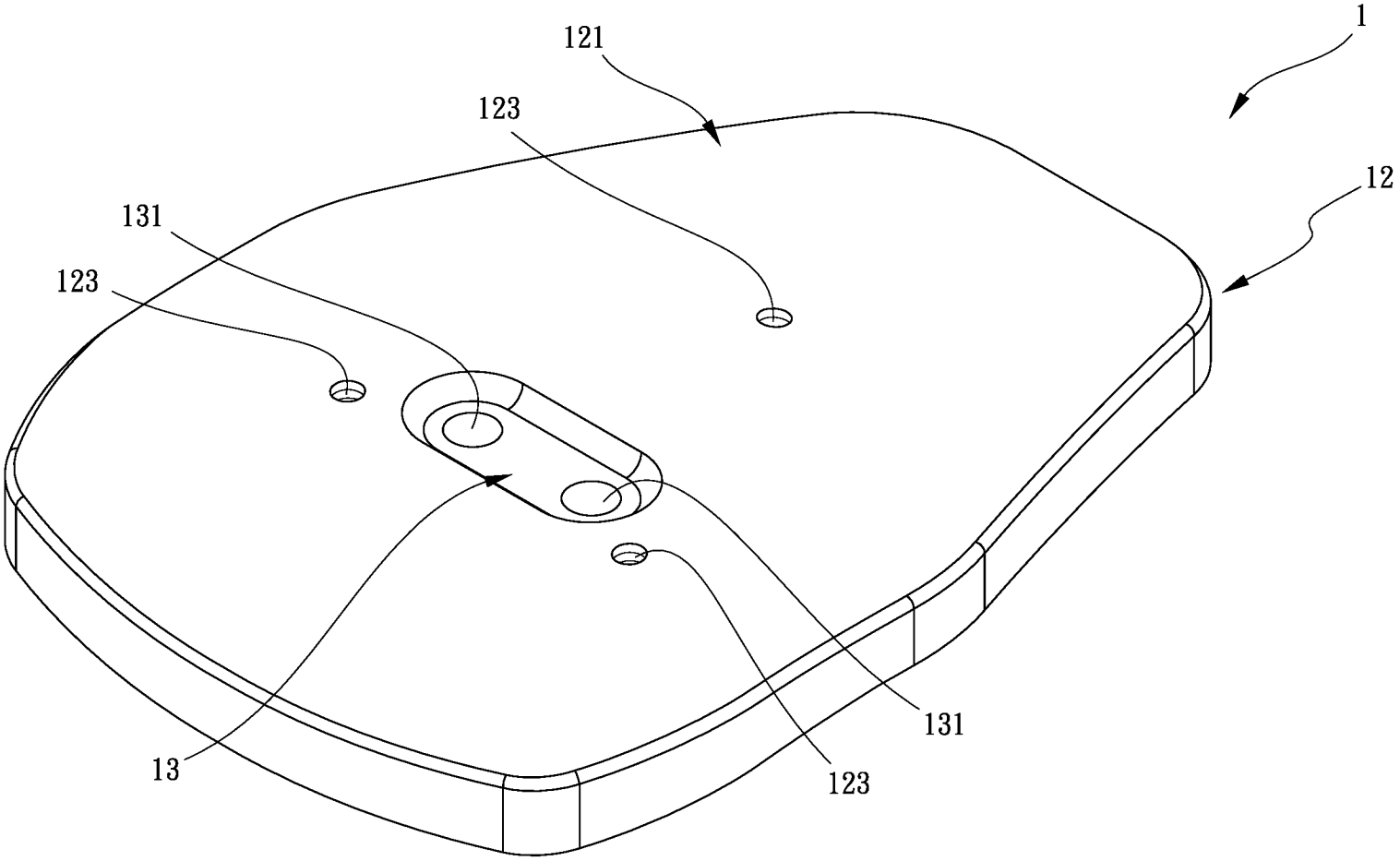
FIG. 1 is a perspective view to show the adaptor of the present invention.

Referring to FIGS. 1 to 5, the adaptor 1 for a bicycle shoe 10 of the present invention comprises an engaging portion 11 and a base part 12. The engaging portion 11 is formed on the first side of the base part 12, and protrudes from the first side of the base part 12 so as to be connected to underside of a bicycle shoe 10. An elongate recess 13 is defined in the second side of the base part 12, and two first holes 131 are defined through the inner bottom of the recess 13. The two first holes 131 are also defined through the engaging portion 11. Two locking members 2 extend through the two first holes 131 and are connected to the bicycle shoe 10. A cleat 30 is removably connected to the second side of the base part 12, wherein the second side of the base part 12 is opposite to the first side of the base part 12.

The first side of the base part 12 includes a bottom 122 to which the engaging portion 11 is formed. The second side of the base part 12 is a curve face 121 that is designed to meet ergonomic requirements. The second side of the base part 12 is to be connected to the cleat 30. The curve face 121 includes at least three second holes 123 such that three bolts 301 extend through the cleat 30 and are connected to the at least three second holes 123 so as to match the cleat 30 to the curve face 121 of the base part 12.

Figure 4:
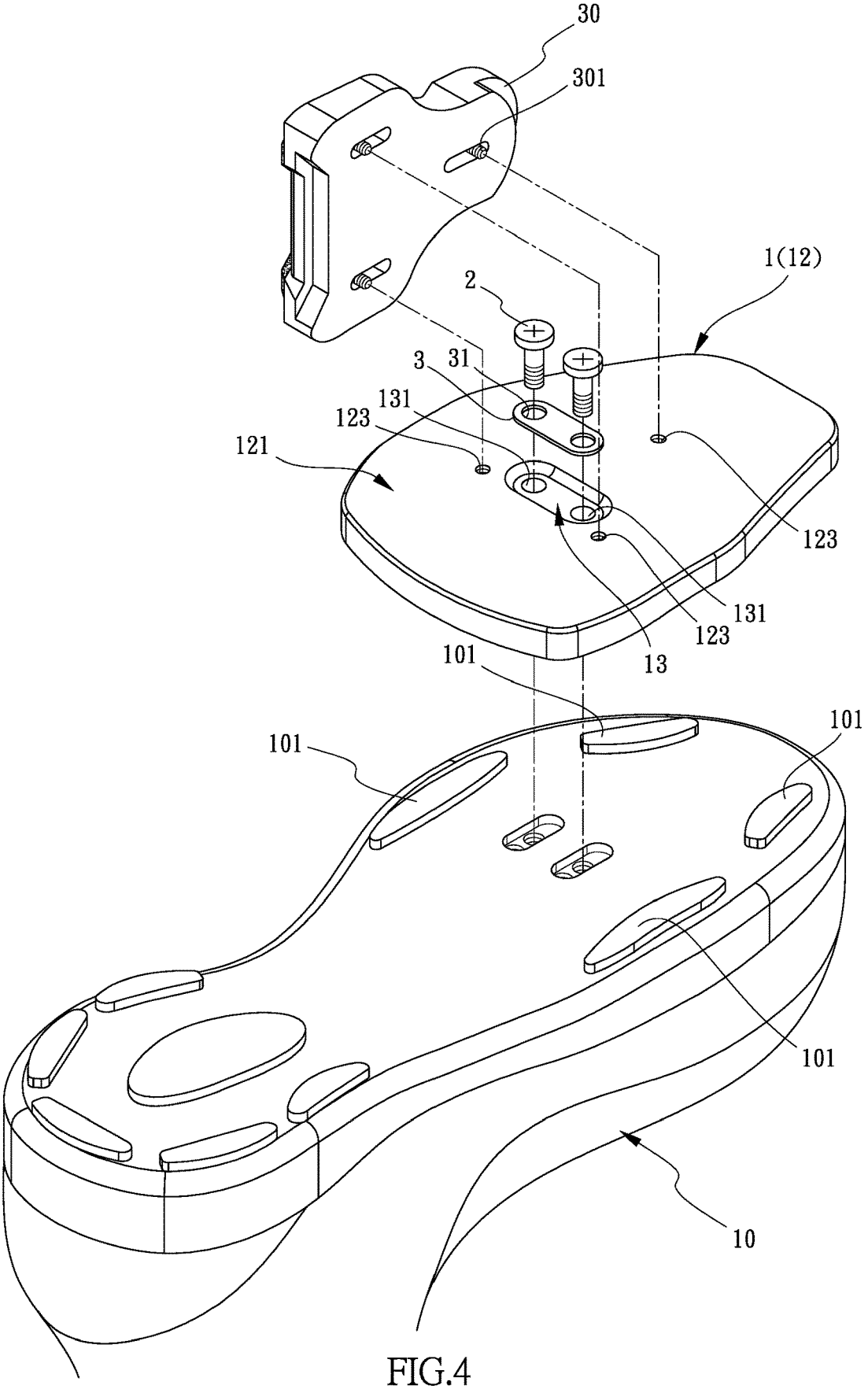
FIG. 4 is an exploded view to show the adaptor of the present invention, the bicycle shoe and the cleat as shown in FIG. 3.
Figure 5:
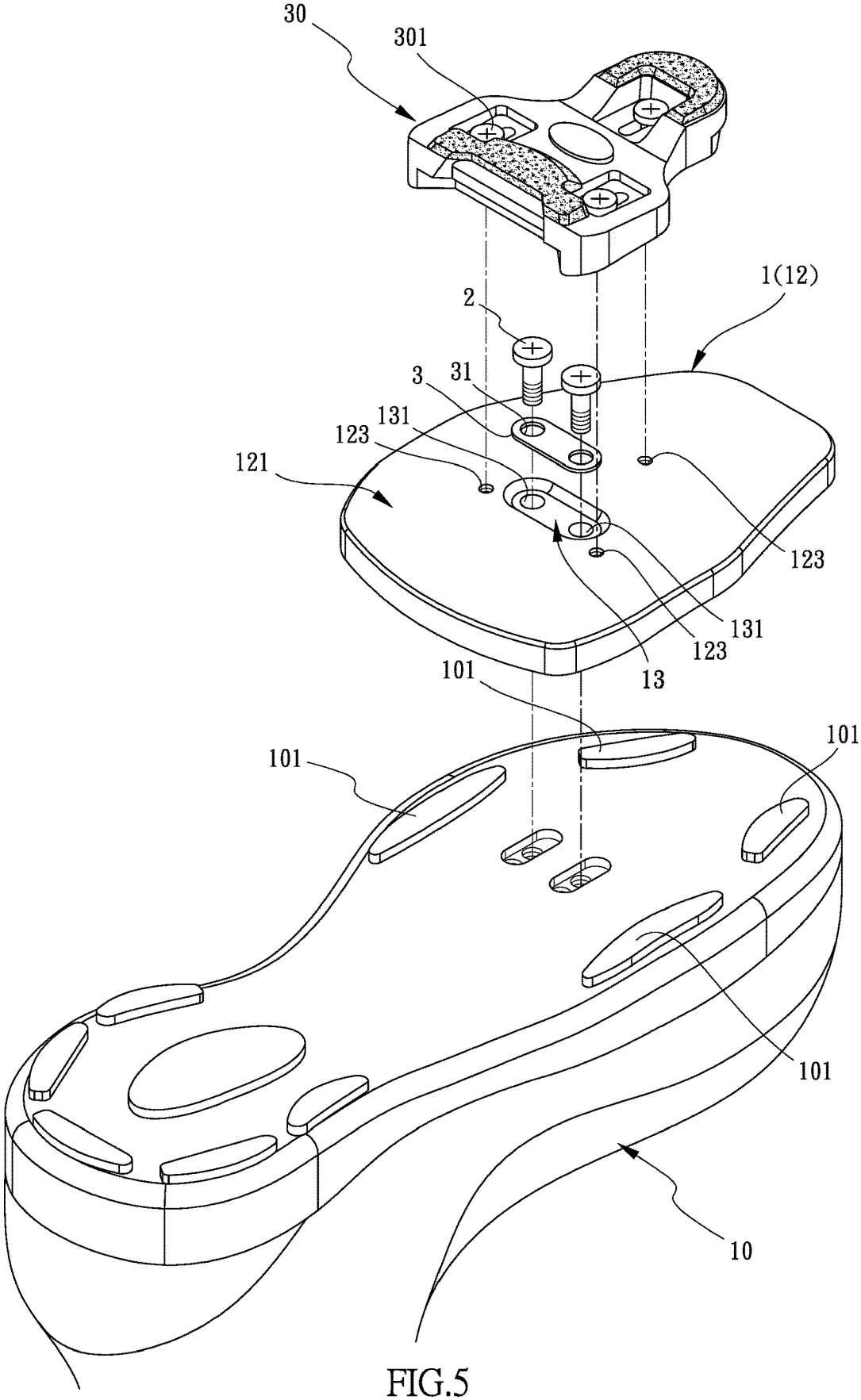
FIG. 5 is another exploded view to show the adaptor of the present invention, the bicycle shoe and the cleat as shown in FIG. 3.
Figure 6:
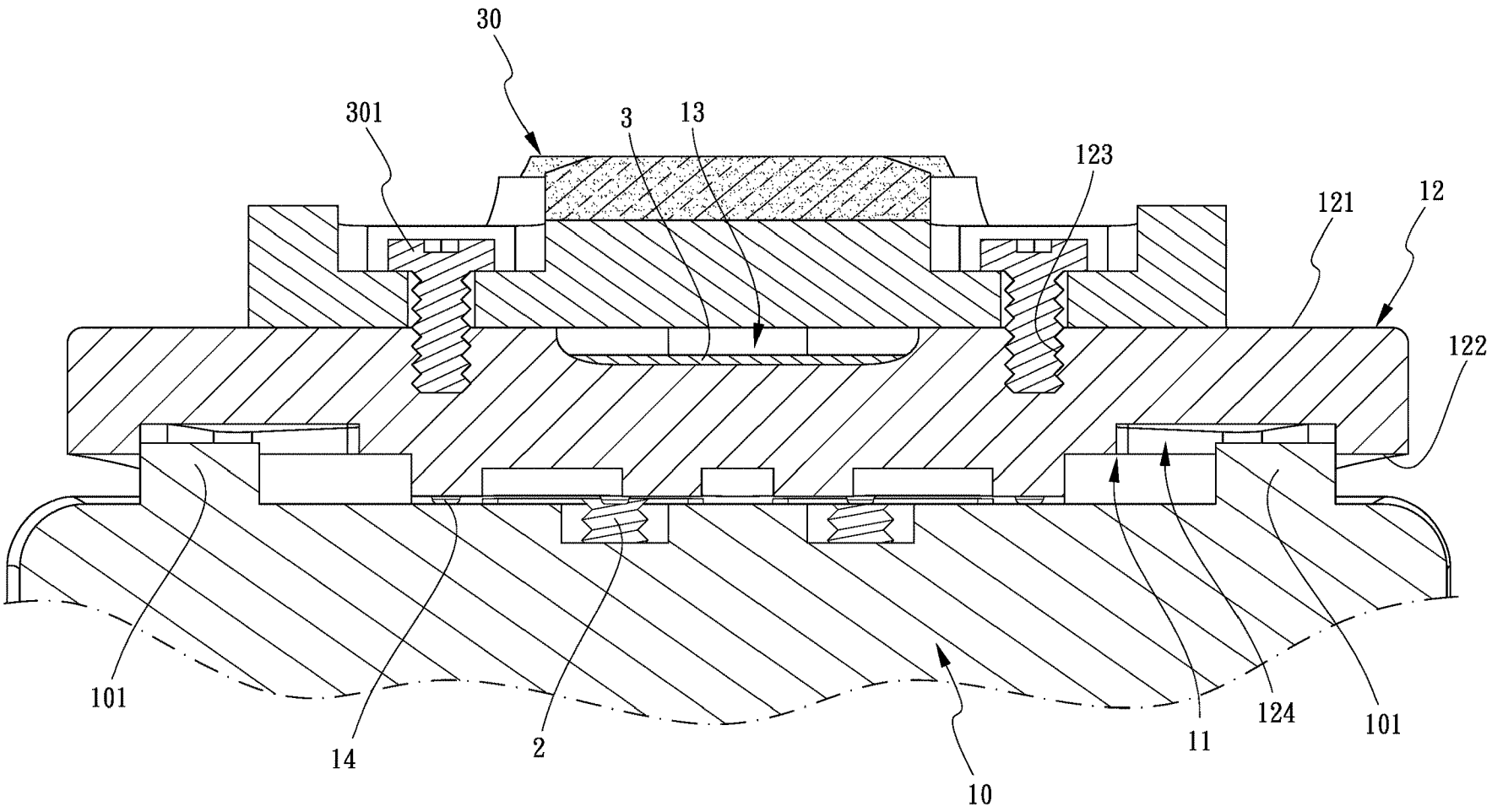
FIG. 6 is a cross sectional view, taken along line VI-VI in FIG. 3.

The bottom 122 of the base part 12 includes multiple cavities 124 and multiple ribs 125 which divide the cavities 124. A ring 126 is formed to the bottom 122 of the base part 12. The engaging portion 11 is enclosed by the ring 126 which is formed with the ribs 125. The ribs 125 and the ring 126 are designed to reinforce the structure of the base part 12. Each cavity 124 includes an inner bottom which is not a flat inner bottom and is composed of multiple inclined surfaces. As shown in FIGS. 4 and 5, there are multiple protrusions 101 protruding from the underside of the bicycle shoe 10 to provide anti-slip function. In addition, when the base part 12 is connected to the underside of the bicycle shoe 10, some of the protrusions 101 are inserted into the cavities 124 so that the protrusions 101 do not affect installation of the base part 12 so that the base part 12 is attached to and matched to the underside of the bicycle shoe 10.

Figure 2:
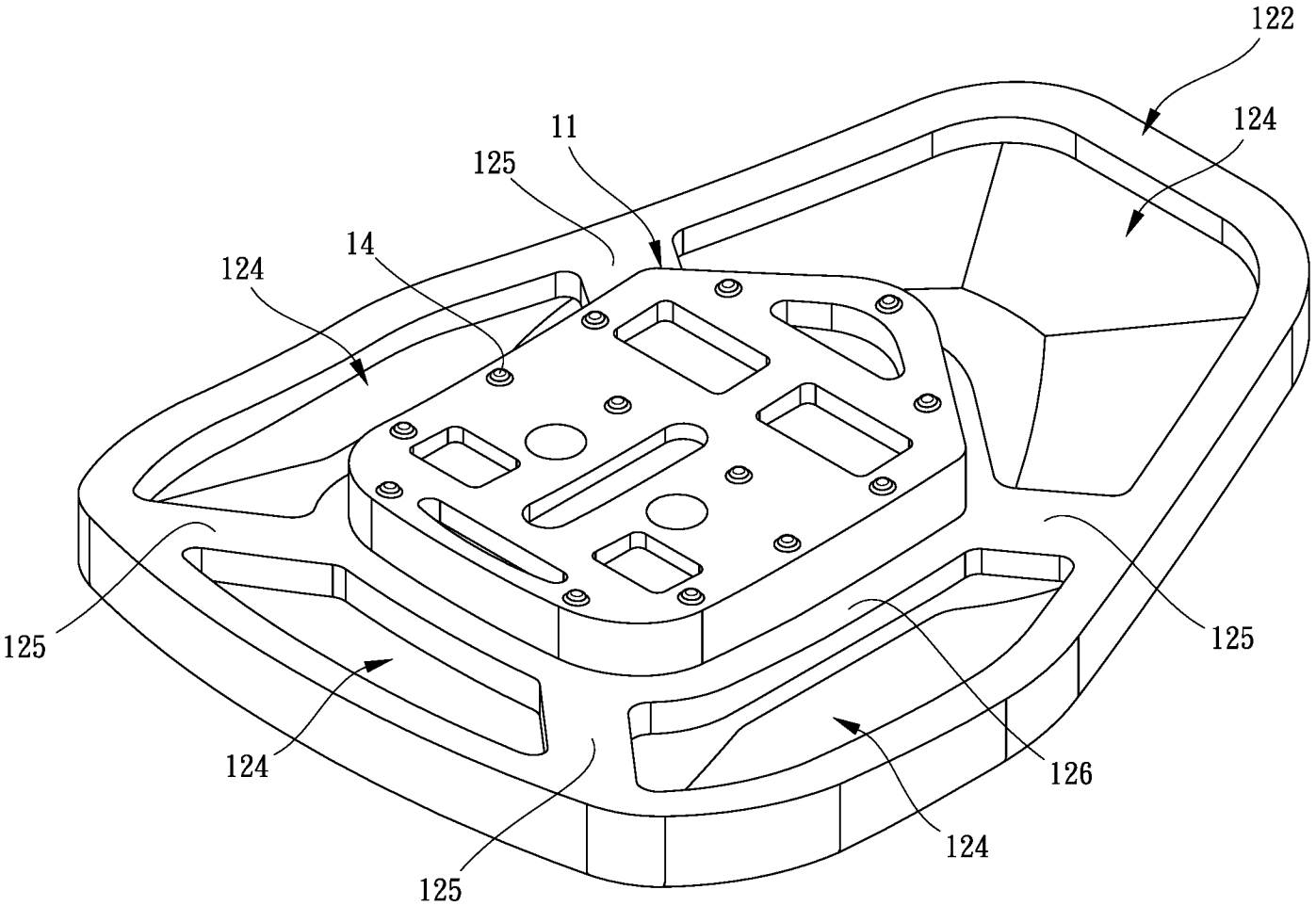
FIG. 2 is another perspective view to show the adaptor of the present invention.
Figure 3:
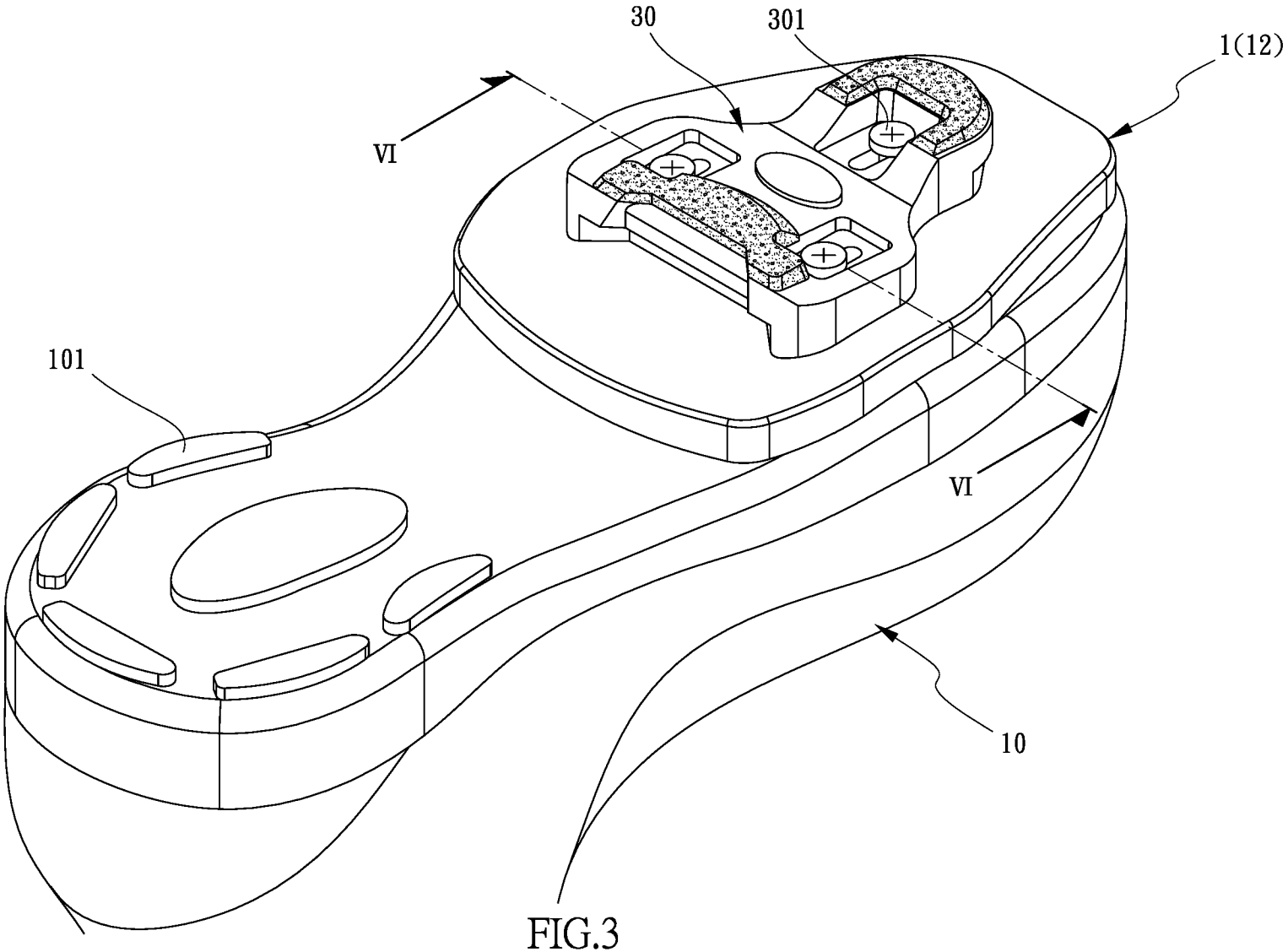
FIG. 3 shows that the adaptor of the present invention is attached to the bicycle shoe, and a cleat is connected to the adapter.

Furthermore, the engaging portion 11 includes multiple bosses 14 protruding from the end face thereof as shown in FIG. 2. The bosses 14 contact the underside of the bicycle shoe 10 so as to generate friction, so that the adaptor 1 does not shift when being connected to the underside of the bicycle shoe 10.

In order to avoid the locking members 2 from hitting the base part 12, a plate 3 is located in the recess 13 and includes two bores 31. The two locking members 2 extend through the two bores 31 and the two first holes 131 so as to be connected to the bicycle shoe 10. The two locking members 2 do not protrude beyond the recess 13. The locking members 2 are hidden in the recess 13 by the cleat 30. By the plate 3, the heads of the locking members 2 do not contact the base part 12 to cause worn between the locking members 2 and the base part 12. The base part 12 is integral with the engaging portion 11 to be a one-piece part which can be made of aluminum alloy to reduce weight.

The users do not prepare two different types of bicycle shoes. The adaptor 1 is easily connected to the bicycle shoe 10 by the two locking members 2. The cleat 30 is easily connected to the base part 1 by extending the bolts 301 through the cleat 30 and are connected to the second holes 123. That is to say, any user can easily connect the cleat 30 to the adaptor 12, or remove the cleat 30 from the adaptor 12.

While we have shown and described the embodiment in accordance with the present invention, it should be clear to those skilled in the art that further embodiments may be made without departing from the scope of the present invention.

What is claimed is:

1. An adaptor for a bicycle shoe, comprising:

an engaging portion and a base part, the engaging portion formed on a first side of the base part, the engaging portion protruding from the first side of the base part and adapted to be connected to an underside of the bicycle shoe;

a recess defined in a second side of the base part, two first holes defined through an inner bottom of the recess, the two first holes defined through the engaging portion, two locking members extending through the two first holes and adapted to be connected to the bicycle shoe, wherein the first side of the base part includes a bottom to which the engaging portion is formed, the second side of the base part is a curve face that is adapted to be connected to the cleat, the curve face includes at least three second holes such that three bolts extend through the cleat and are connected to the at least three second holes; and a second side of the base part adapted to be removably connected to a cleat.

2. The adaptor for a bicycle shoe as claimed in claim 1, wherein the bottom of the base part includes multiple cavities and multiple ribs which divide the cavities, a ring is formed to the bottom of the base part, the enaging portion is enclosed by the ring which is formed with the ribs.

3. The adaptor for a bicycle shoe as claimed in claim 2, wherein each cavity includes an inner bottom which is not a flat inner bottom and is composed of multiple inclined surfaces.

4. The adaptor for a bicycle shoe as claimed in claim 1, wherein the engaging portion includes multiple bosses protruding from an end face thereof the bosses are adapted to contact the underside of the bicycle shoe so as to generate friction.

5. The adaptor for a bicycle shoe as claimed in claim 1, wherein a plate is located in the recess and includes two bores, the two locking members extend through the two bores and the two first holes so as to be connected to the bicycle shoe.

6. The adaptor for a bicycle shoe as claimed in claim 5, wherein the two locking members do not protrude beyond the recess.

* * * * *